US009726451B2

(12) United States Patent
Masters

(10) Patent No.: US 9,726,451 B2
(45) Date of Patent: Aug. 8, 2017

(54) MODULAR SLINGSHOT

(71) Applicant: SimpleShot, Inc., Candler, NC (US)

(72) Inventor: Nathan Masters, Asheville, NC (US)

(73) Assignee: SimpleShot, Inc., Candler, NC (US)

( * ) Notice: Subject to any disclaimer, the term of this patent is extended or adjusted under 35 U.S.C. 154(b) by 0 days.

(21) Appl. No.: 15/148,053

(22) Filed: May 6, 2016

(65) Prior Publication Data

US 2016/0327358 A1 Nov. 10, 2016

Related U.S. Application Data

(60) Provisional application No. 62/157,669, filed on May 6, 2015.

(51) Int. Cl.
*F41B 3/02* (2006.01)

(52) U.S. Cl.
CPC ..... *F41B 3/02* (2013.01)

(58) Field of Classification Search
CPC ..... F41B 3/02
See application file for complete search history.

(56) References Cited

U.S. PATENT DOCUMENTS 3,057,337 A * 10/1962 Rock ..... F41B 3/02 124/20.2
3,101,704 A * 8/1963 McCormick ..... F41B 3/02 124/17
3,494,346 A * 2/1970 Yount ..... F41B 3/02 124/20.1
3,524,439 A * 8/1970 Dantzler ..... F41B 3/02 124/17
3,614,947 A * 10/1971 Feldman ..... F41B 3/02 124/20.3
3,974,820 A * 8/1976 Ott ..... F41B 3/02 124/20.1
4,373,503 A * 2/1983 Saunders ..... F41B 3/02 124/20.1
5,579,751 A * 12/1996 Lin ..... F41B 3/02 124/1

* cited by examiner

*Primary Examiner* — John Ricci
(74) *Attorney, Agent, or Firm* — McNair Law Firm, P.A.; Douglas W. Kim

(57) ABSTRACT

The above objectives are accomplished according to the present invention by providing A modular slingshot comprising: a handle having a spring recess; a spring attached to the handle being received in the spring recess having a serrated portion and spring tab; a fork removably attached to the handle having a tab recess for receiving the spring tab to secure the fork on the handle; and, band securing assembly including plugs that are attached to the forks.

20 Claims, 18 Drawing Sheets

MODULAR SLINGSHOT

BACKGROUND OF THE INVENTION

1) Field of the Invention

The present invention relates to a modular slingshot including a fork removably attached to a handle and band securing assembly.

2) Description of Related Art

Slingshots depend on strong elastic materials, typically vulcanized natural rubber or the equivalent, to propel a projectile for purpose of recreation, hunting, and the like. At their inception, slingshots were generally "home-made" with little in the way of professional design or safety. For example, designs that use loose parts at the forks can cause these parts to fail causing these parts to be propelled backwards at the user. Further, the bands can fail with wear and over time. Current designs that do not allow for the replacement of bands are more dangerous than those with replaceable bands. In one commercial design, the bands were improperly secure to the forks resulting in failure of the slingshot and a recall of these products by the manufacturer. It was learned that use of the knot in the bands were simply not satisfactory and posed a significant danger to the user.

In the development of the slingshot, it has been discovered that the relationship between the bands and the forks produces different performance results. Therefore, it would be desirable to have the ability to quickly change forks based upon the particular user's needs, rather than to have to completely change slingshots.

As the slingshots were further developed, projectiles began to include arrows. Therefore, a slingshot that can use various ammunitions, including ball bearing, shot, and arrows if desirable. Further, the use of the slingshot to disperse bait or seed, rather than ammunition, is also desirable.

Accordingly, it is an object of the present invention to provide for a modular slingshot with the ability to safely remove and attach forks and elastic propulsion bands.

SUMMARY OF THE INVENTION

The above objectives are accomplished according to the present invention by providing a modular slingshot that can include a handle, a saddle having a convex front face and a convex rear face, a fork having fork arms and a fork extension received into the saddle, a fork opening included in each fork arm, a plug received into each fork opening configured to secure a band to the fork, a thin cone portion included in the plug configured to accommodate thin bands, a thick cone portion included in the plug configured to accommodate thick bands disposed on an opposite of the thin cone portion, lateral groves included in the plug configured to accommodate a tubular band, front groves included in the plug configured to accommodate a tubular band, a bore included in the plug configured to accommodate a hollow tubular band, a stopper configured to be received into a cavity of a hollow tubular band to expand the diameter of the hollow tubular band to secure the hollow tubular band to the fork, a wrist brace removably attached to the handle, an arrow rest removably attached to the fork arms by a mounting bracket; and, lateral stops include in the mounting bracket configured to prevent the band from entering the arrow stop prior to a projective exiting the arrow rest.

The slingshot can include a spring attached to the handle that is configured to engage with a spring tab included in the fork to secure the fork to the handle when the fork is fully received into the handle. The spring and the spring tab can be operatively associated and configured to provide an audible indication that the fork is secured to the handle by the spring.

The slingshot can include a thick indicator indicating the orientation of the thick cone portion when a thick band is used and a thin band indicator indicating the orientation of the thin cone portion when a thin band is used. Aiming points can be defined in the fork arms and disposed on lateral outer edges of the fork arms. Aiming points can also be defined in upper distal ends of the mounting bracket. A mounting rail can be attached to the handle. A heel can be included in the handle wherein the mounting rail is attached to the heel. A brace plate can be removable attached to the handle for securing the wrist brace to the handle. A brace opening can be included in the handle to receive a bolt to removably secure the wrist brace to the handle. A lanyard can be attached to the brace opening. A brace slot can be disposed horizontally, adjacent to a heel included in the handle and defined in the front of the handle for receiving the wrist brace. An adjustable wrist strap can be attached to the wrist brace having a modifiable diameter to accommodate varying forearm diameters of the user and configured to allow the user to maintain a projectile orthogonal to the arrow rest. The handle can include a rear curvature included in a convex rear face that is greater than a front curvature included of the convex front face.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples.

However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
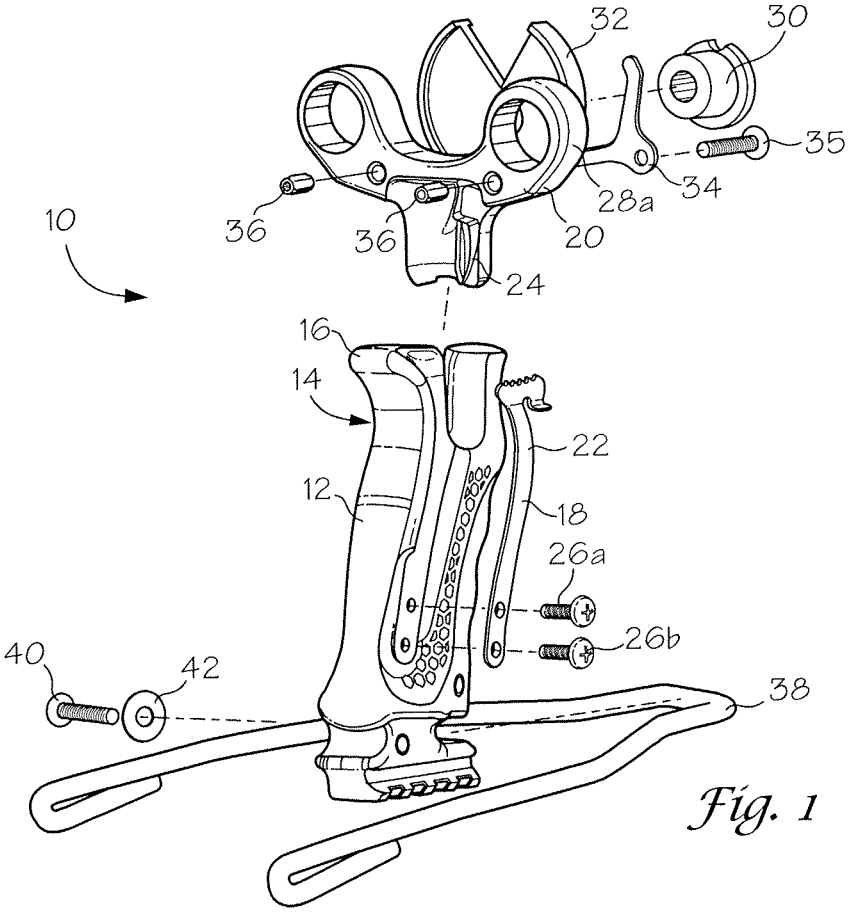
FIG. 1 is a perspective exploded view of aspects of the invention.

Referring to FIG. 1, a slingshot shown generally at 10 includes a handle 12. The handle include a concave portion 14 and a beavertail 16 to better fit the user's hands. Finger indentions 18 can be included in the front portion of the handle. The beavertail can be used to improve the fit of the handle in the user's hands and also to equally distribute the forces of the handle against the users hands when the bands are under strain which can results in a better grip and safer hold.

The fork 20 is removably attached to the handle and secured by a fork securing assembly. The fork securing assembly can include a spring 22 attached to the lower end of the handle that is operatively associated with the fork at a securing extension 24. When the fork is attached to the handle, the securing extension can engage with the spring to secure the fork to the handle with a notable audible indication that the fork is securely attached. In one embodiment, the notable audible indication is a click produced by the spring "snapping" due to a recess in the handle. This provide a safety feature by indicating that the fork is secured to the handle. The spring can be secured to the bottom of the handle with one or more screws 26*a* and 26*b* in one embodiment.

The fork can include fork arms each having a lateral opening 28*a* and 28*b*. The opening of each fork leg can received one end of the band and a plug 30. The bands can include a pad for holding ammunition such as projectiles and arrows. In one embodiment, the plug can include a bore that can receive a stopper or other element to increase the diameter of the plug to add extra security for securing the band to the forks. For example, when the band is made from thin latex.

An arrow rest 32 can be attached to the fork so that it is disposed between the forks and secured to the forks by a mounting bracket or bracket 34. The bracket can be attached to the forks by bolt 35 which is received through the bracket and into an insert 36. A pair of bolts and inserts can be used in one embodiment. The bracket is secured to the fork at two lateral positions to assist keeping the arrow rest parallel with the forks during use. The bracket is arranged to provide sufficient clearance so as not to interfere with the operation when shooting an arrow. The bracket can also prevent the bands from passing through the arrow rest in operation. Arrow rest extensions (33 of FIG. 18) can be included on the forks to position the arrow rest forward the forks to further assist with providing sufficient clearance.

A wrist brace 38 can be removably attached to the handle through bolt 40 and brace plate 42 so that the wrist brace can have a horizontal position and a vertical position. The heel can include lateral lower stops 31*a* through 31*b* to support the hand when held by the user as shown in FIGS. 20A and 20B. The wrist brace can also fold forward for a compact footprint for transportation, storage and the like.

Figure 2:
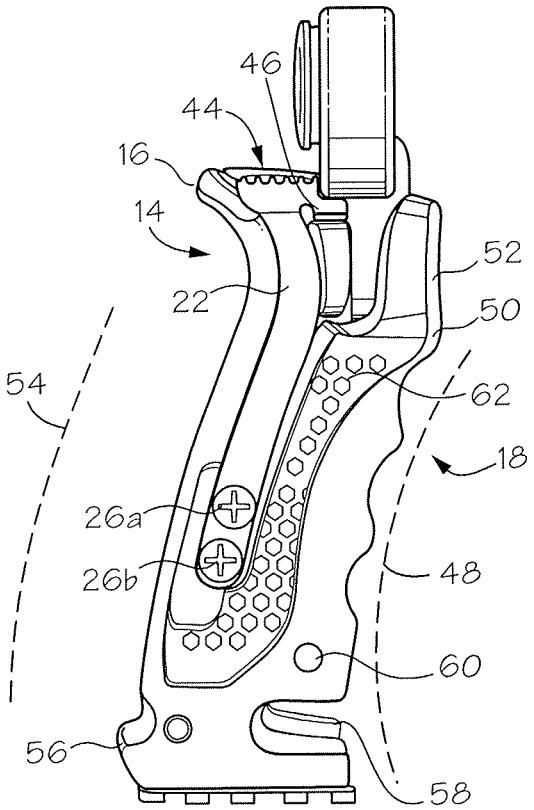
FIG. 2 is a side view of aspects of the invention.

Referring to FIG. 2, the handle is shown in one embodiment to include finger indentions 18. The spring can include serrated portion 44 allowing a better grip on the spring to push it laterally to release the spring from the fork. Spring tab 46 engages the securing extension to secure the fork to the handle. The handle can include a front radiused portion 48, transition portion 50 and upper portion 52 included on the front face of the handle in one embodiment. A rear radiused portion 54 can be included on the rear of the handle. A heel 56 can be included in the handle attached to the bottom of the handle. Brace slot 58 can be defined in the handle to receive the wrist brace. Brace opening 60 defined in the handle can receive bolt 40 to secure brace plate 42 to the handle. The handle can include a honeycomb portion with indentions defined in the handle to reduce weight and increase grip. This pattern can include safety the manufacturing process by reducing the mass of the component such as in injection molding. In one embodiment, a mounting rail, such as a weaver or picatinny rail, can be included on the bottom of the handle and can be attached to the heel. The rail allow for the attachment of other articles such as lights, laser aiming devices, ammunition holders, optics, and the like. The bottom portion of the handle can be removed in one embodiment so that the opening that receives the wrist brace or its securing assembly can be used to secure a lanyard to the handle to improve safety.

Figure 3:
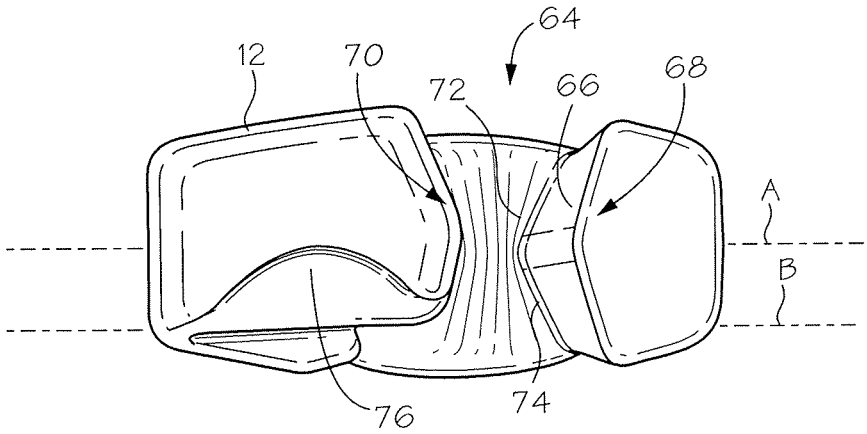
FIG. 3 is a top down view of the handle.

Referring to FIG. 3, the handle includes a saddle 64 defined in the handle to receive the forks. The saddle can include a ridge 66 that generally runs along a ridge in the middle of the saddle resulting in a convex front face 68 and convex rear face 70. The convex rear face can include an rear curvature larger than a front curvature of the convex front face to maximize contact with the fork and support the rearward force from the fork when the invention is in use. In one embodiment, the distance between the two faces 72 is smaller along cross-section A than the distance 74 between the two faces along cross-section B. A thumb recess 76 can be defined in the handle to assist with releasing the spring allowing the front fork to be removed. This configuration reduces "play" between the forks and handle, especially after wear due to friction between the forks and the handle from use.

Figure 4:
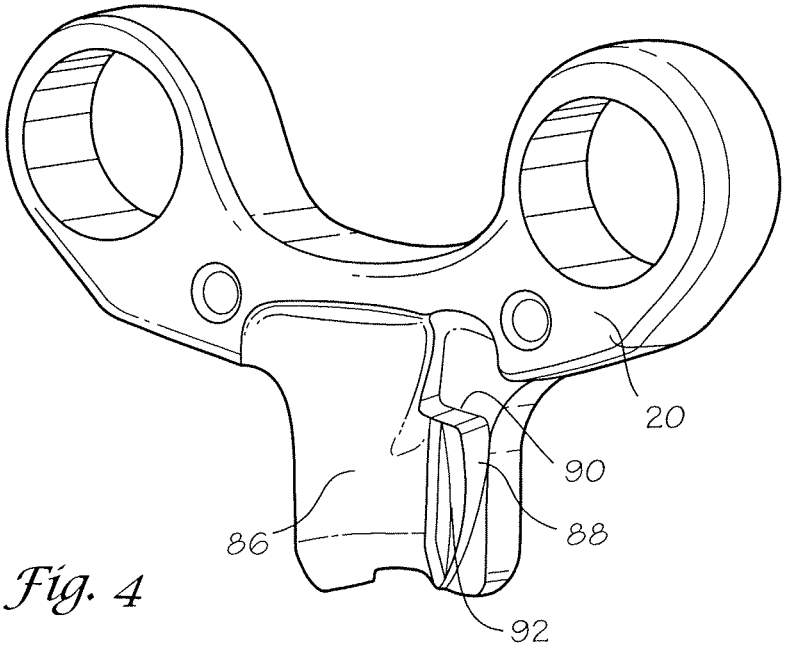
FIG. 4 is a perspective view of the forks.

Referring to FIG. 4, the fork 20 is shown with a rear concave portion 86 that engages the convex rear face of the handle when the fork is placed in the handle. The spring engaged a curved portion 88 of the securing extension forcing the spring laterally outward from the handle when the fork is pressed on the handle. When the fork is fully inserted, the spring tab is received into tab area 90 of the fork and contacts the top of the securing extension to secure the fork in place. The securing extension can include a recess 92 to allow the spring to move laterally in its recess when the fork in place.

Figure 5:
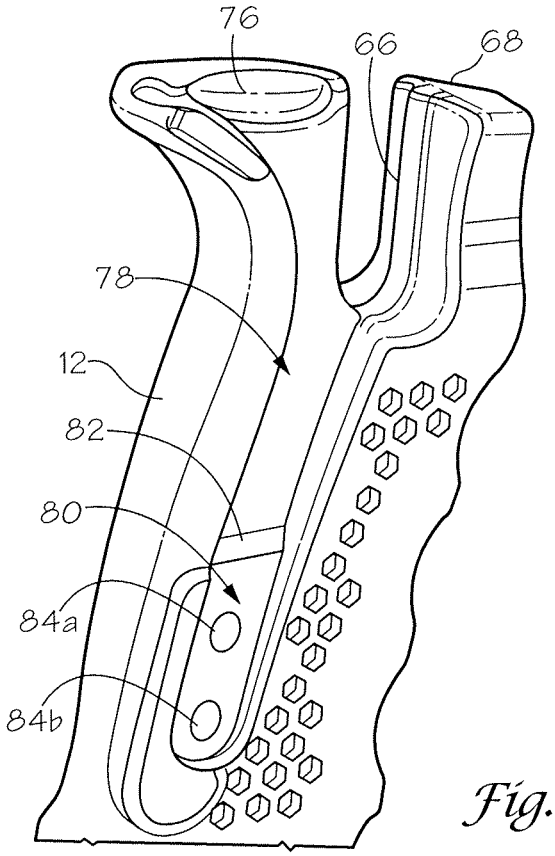
FIG. 5 is a perspective view of the handle.

Referring to FIG. 5, the handle can include an upper spring recess 78 for receiving the spring in a secured position for securing the fork to the handle. When the fork is pressed into the handle, the spring can produce an audible indicator (e,g, snap or clink) that the fork is properly seated. This indicator is enhanced by the upper spring recess. A mounting recess 80 can include opening 84*a* and 84*b* for receiving bolts that secure the spring to the handle. The bolts can be received in openings in the spring and secure to the handle. A ramp 82 can be included to provide differing depths of the mounting recess and the upper spring recess.

Figure 6:
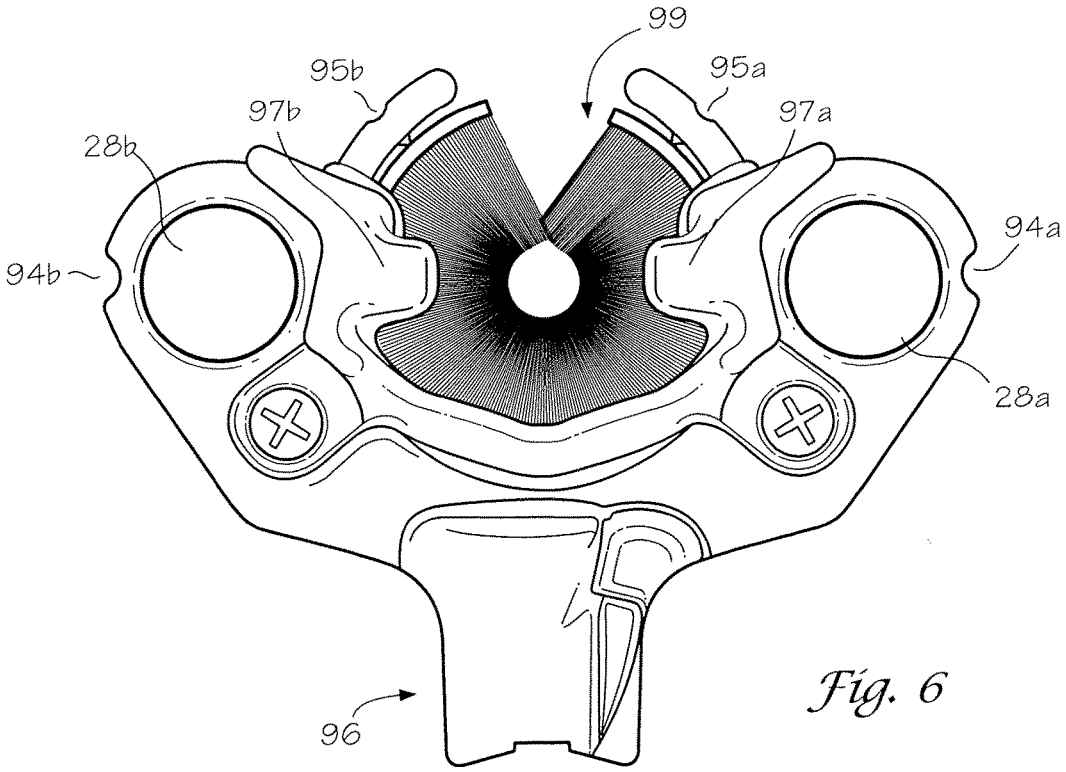
FIG. 6 is a perspective view of the forks.

Referring to FIG. 6, the fork extension 96 can include a rear concave portion that engages the convex front face of the handle when the fork is placed in the handle such as when the fork extension is received in the saddle. In one embodiment, the forks can include aiming points or reference points 94*a* and 94*b* on the outer lateral edges of the fork openings 28*a* and 28*b*. The reference points can assist in aiming the projective fired form the invention. Secondary aiming points 95*a* and 95*b* can be included generally at the upper distal ends of the mounting bracket. These reference points can be used when the arrow rest is attached. The mounting bracket can include lateral stops 97*a* and 97*b* that extend into a whisker area 99 of the arrow rest and can prevent the band and other attachments to the bands from entering the whiskers prior to the arrow editing the whiskers.

Figure 7:
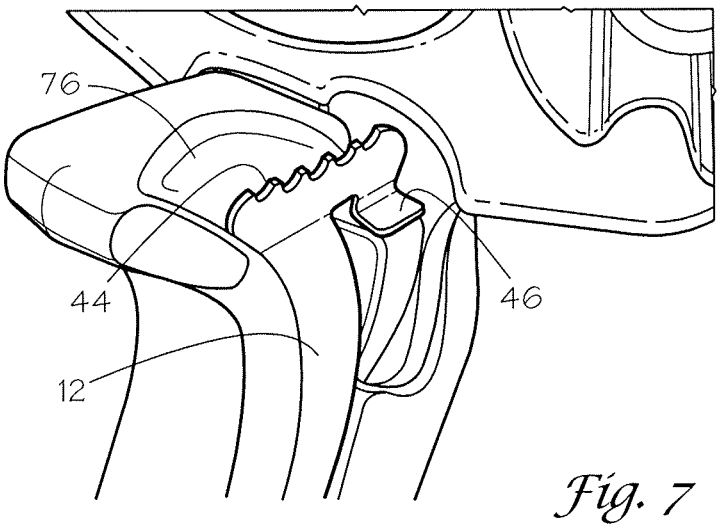
FIG. 7 is perspective view of aspects of the inventions.

Referring to FIG. 7, the fork is shown secured to the handle. The spring is received in the spring recess are. The spring tab is engaged with the tab area of the fork preventing the fork from moving up and away from the handle during use.

Figure 8:
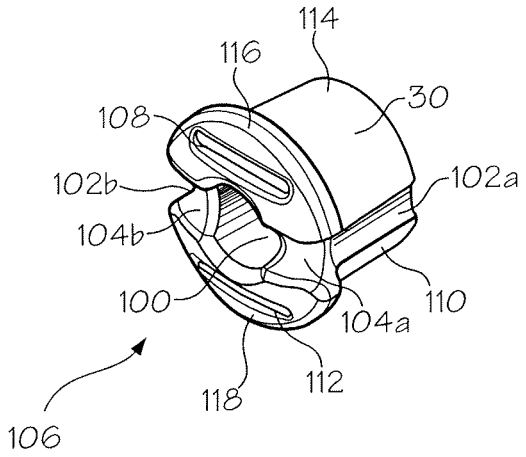
FIG. 8 is perspective view of aspects of the inventions.
Figure 9:
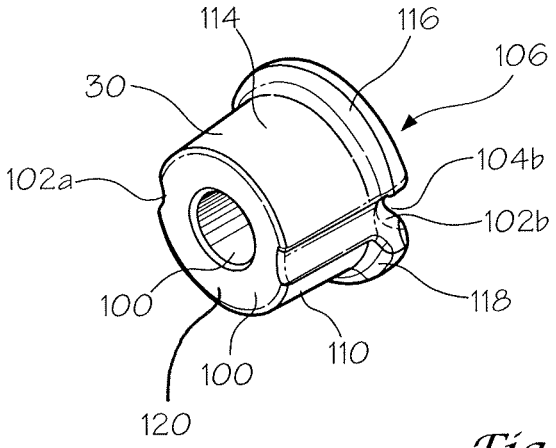
FIG. 9 is perspective view of aspects of the inventions.

Referring to FIGS. 8 and 9, a plug 30 is shown. A bore 100 is defined in the plug and extending through the plug. Lateral groves 102*a* and 102*b* can be included in the side of the plug. Front groves 104*a* and 104*b* can be defined in the front side 106 of the plug. The plug can be used with various types of bands such as flat, thick, thin, round, or tubing. The plug can be marked with a thick indicator 108 to show that the thick cone portion 110 is used for think bands. A thin band indicator 112 can be included to indicate that a thin band should be used with the thin cone portion 114 of the cone. The plug can include a radial shoulder that includes an upper shoulder 116 and a lower shoulder 118 in one embodiment. The rear of the plug is shown having a back cap 120.

Figure 10:
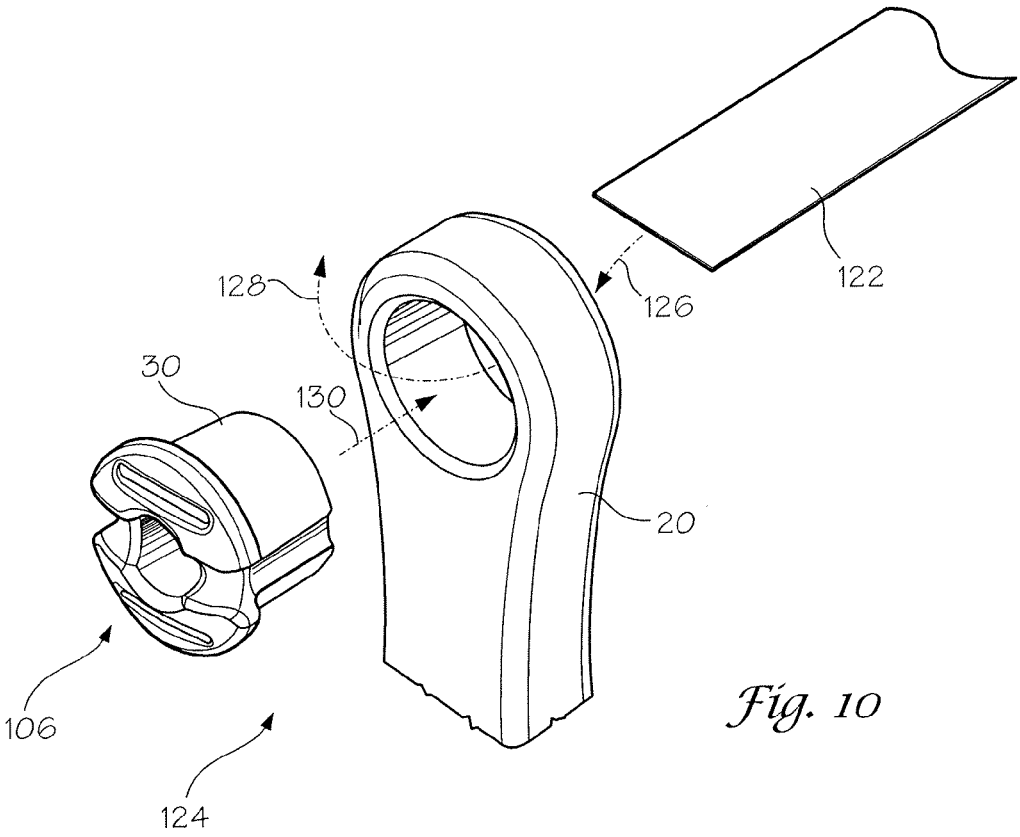
FIG. 10 is perspective view of aspects of the inventions.
Figure 11:
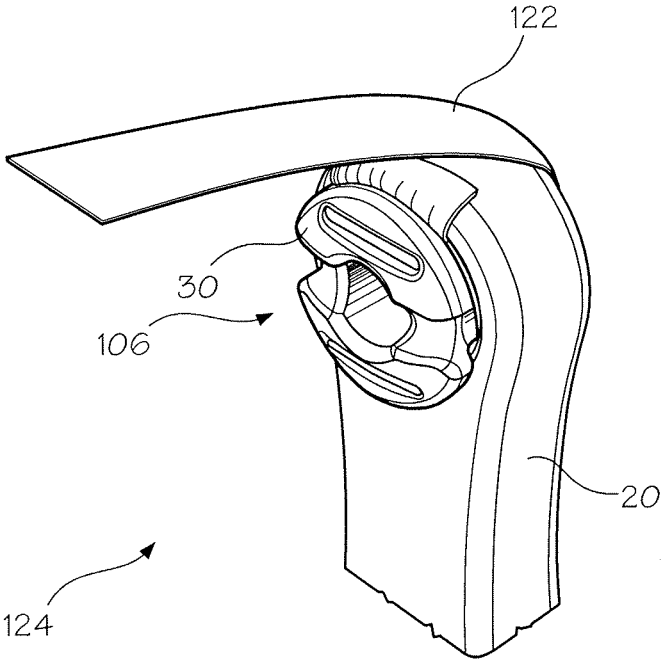
FIG. 11 is perspective view of aspects of the inventions.
Figure 16:
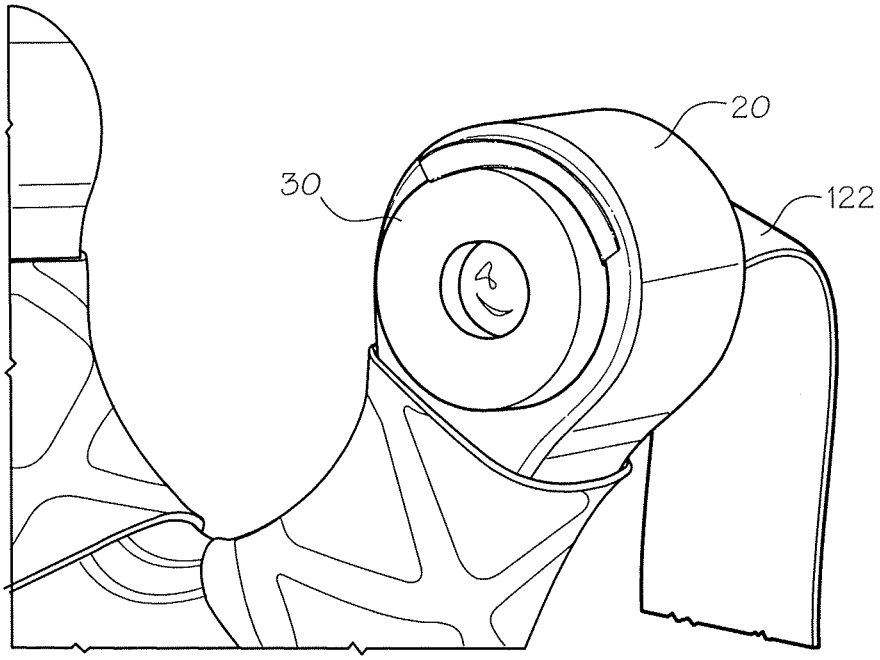
FIG. 16 is perspective view of aspects of the inventions.
Figure 17:
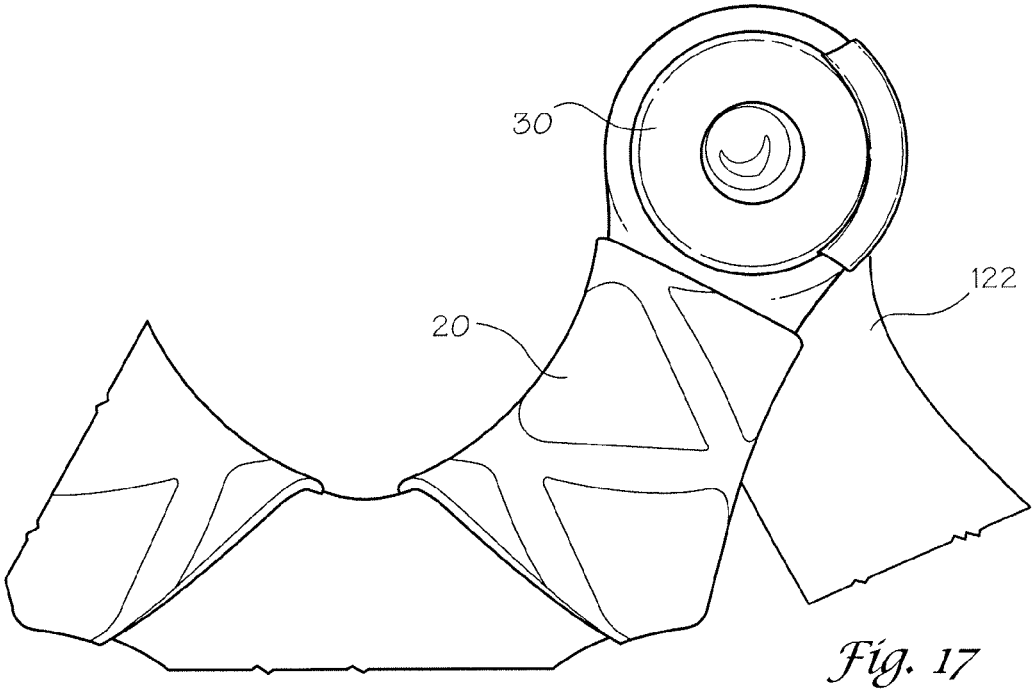
FIG. 17 is perspective view of aspects of the inventions.

Referring to FIG. 10, the fork 20 is shown with opening 28*a* for receiving the plug. A thin band 122 is inserted at direction 126 into the opening so that a portion of the thin band extends out of the opening into the user's side 124. The end of the thin band can travel along path 128 so that the end portion extends through the opening and upwards. The plug is then inserted into the fork opening 28*a* along path 130. Referring to FIGS. 11 and 16-17, the thin band is then folded over the fork and toward the user's area 124 securing the band into the fork.

Figure 12:
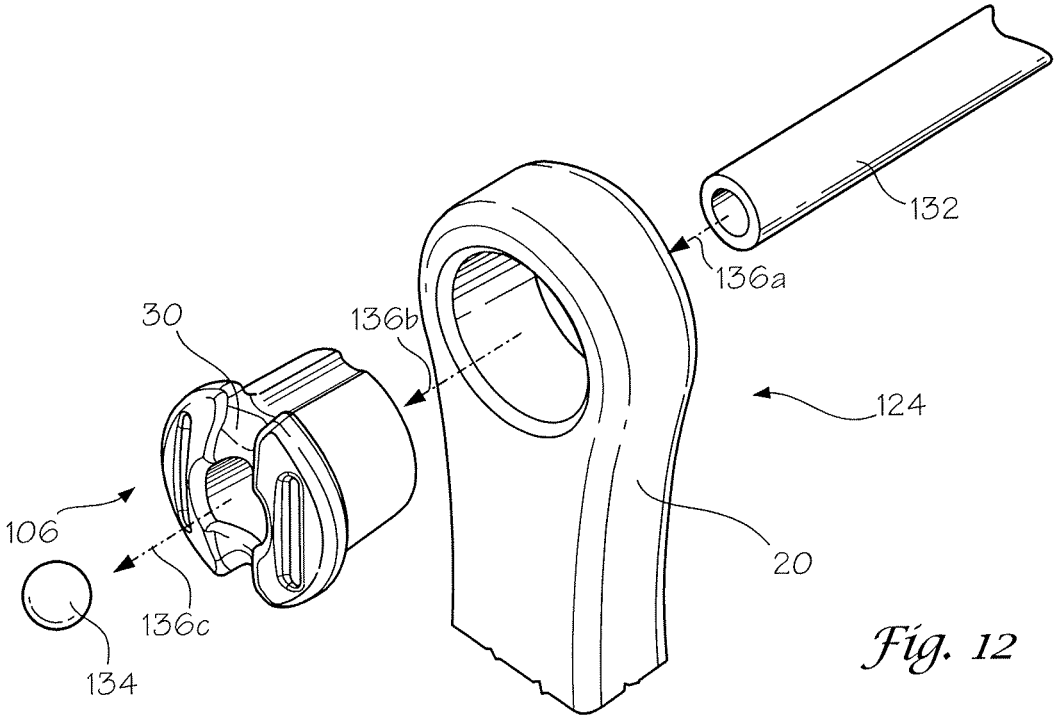
FIG. 12 is perspective view of aspects of the inventions.
Figure 13:
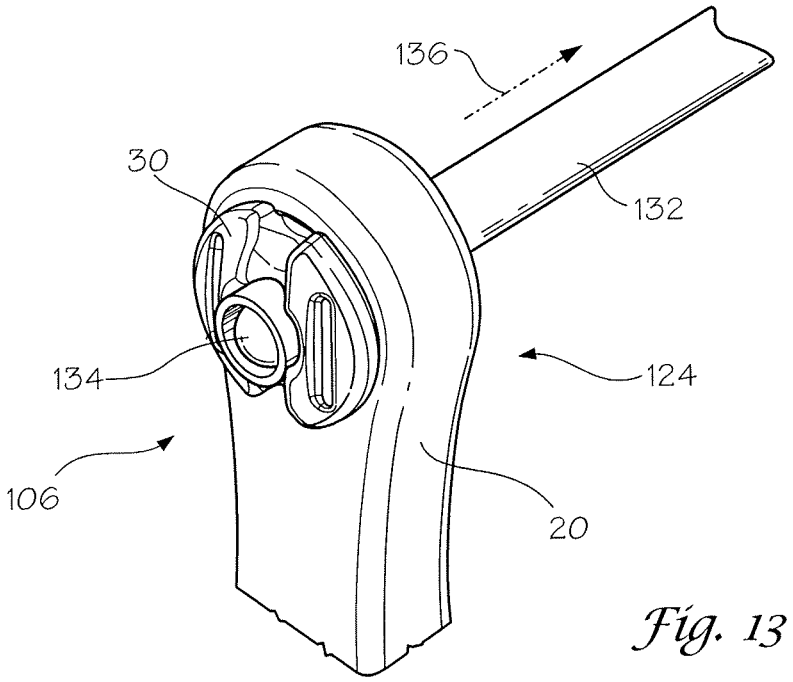
FIG. 13 is perspective view of aspects of the inventions.

Referring to FIGS. 12 and 13, the band securing assembly is shown with a tube 132 being inserted into the opening of the fork and into the bore of the plug along path 136*a* through 136*c*. A generally sphere stopper such as ball 134 or other insert can be placed inside a bore in the tubing. The plug is inserted into the opening in the fork. When tension is placed on the band in a direction 137, the ball prevents the band from traveling through the plug thereby securing the band to the fork. In one embodiment, other member can be used to secure the tube into the plug. Referring to FIGS. 19A through 19C, a stopper 200 can be used. The stopper can be of other design other than the ball previously described. For example, the stopper can include a cap 202, resilient member 204, and base plate 206. In one embodiment, the stopper include an expansion member 210. When the stopper is placed in the tubing and the base plate is forced toward the cap in direction 218, the resilient member and expansion member expands to create a diameter larger than the bore and thereby secure the tubing in the plug. The base plate can be forced toward the cap with a threaded member 212, nut 214 or lever 216.

Figure 14:
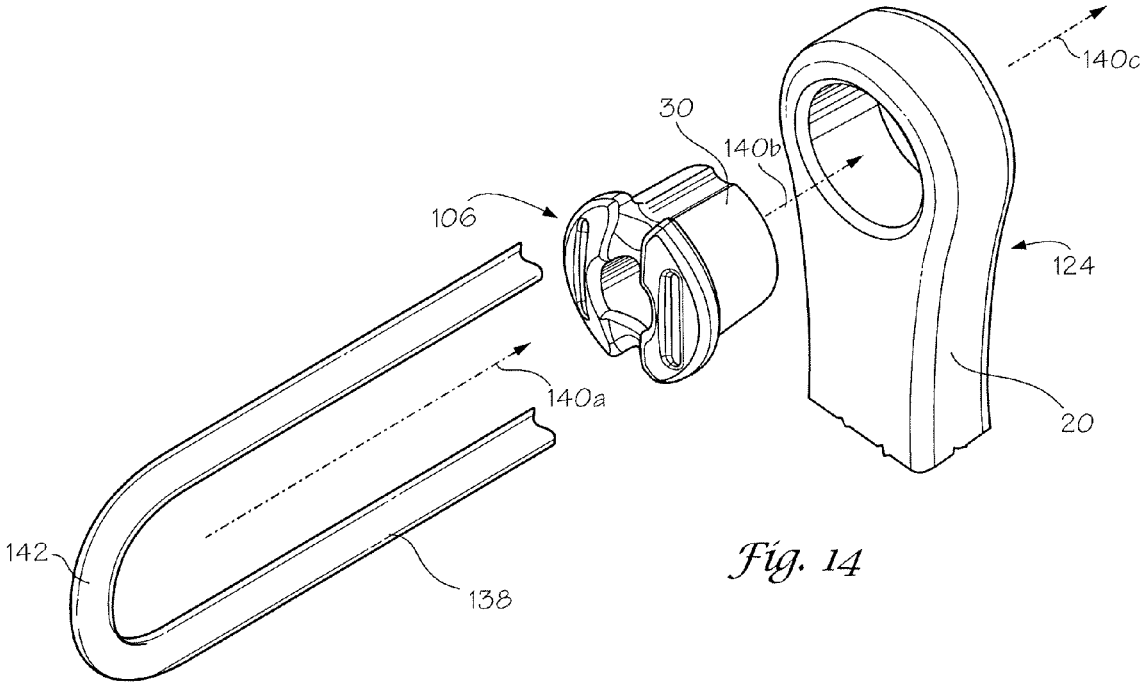
FIG. 14 is perspective view of aspects of the inventions.
Figure 15:
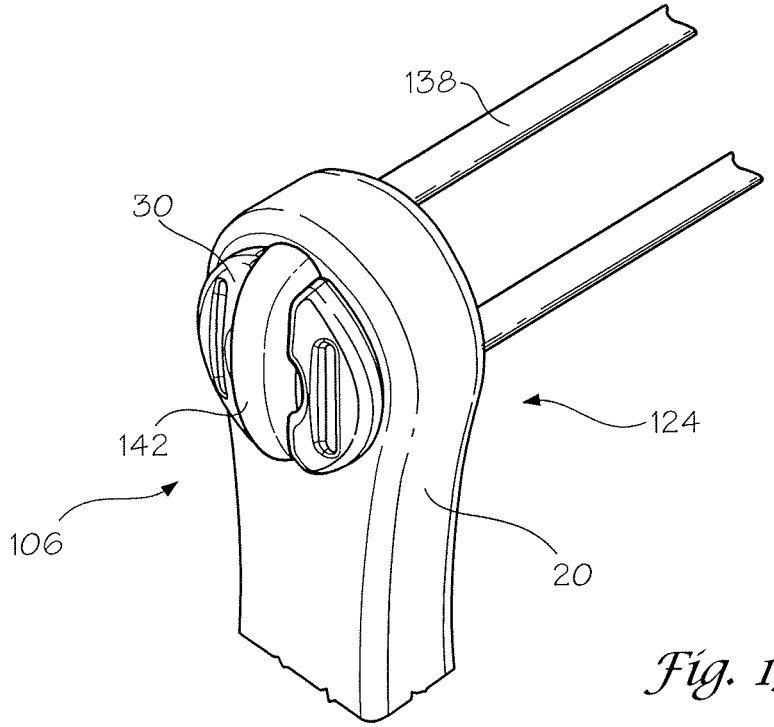
FIG. 15 is perspective view of aspects of the inventions.

Referring to FIG. 14, the invention is shown when used with a band that is doubled over. In this case, the doubled band 138 is inserted into the opening with the plug between the distal end 142 of the band and the fork. The band then travels in a direction shown as 140*a* through 140*c* with the plug so that the band is received in the front and side grooves. Referring to FIG. 15, the doubled band is secured to the fork.

Figure 18:
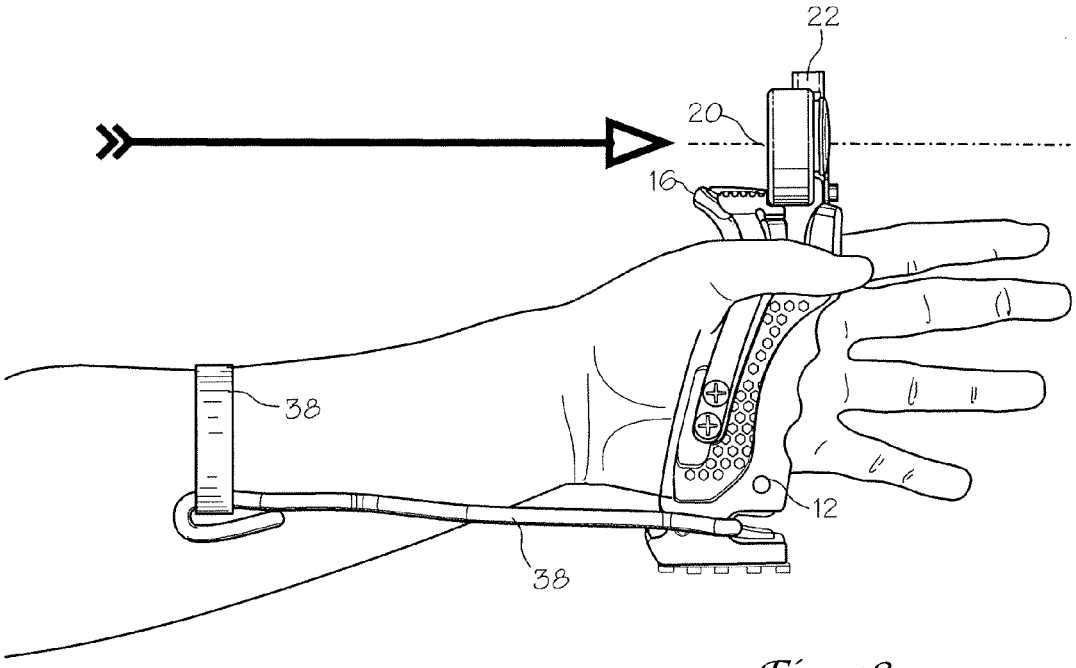
FIG. 18 is a side view of the invention.

Referring to FIG. 18, the handle 12 is shown held with the arrow rest 32 vertical and generally orthogonal in relation to an arrow. In order to maximize accuracy, the arrow should be 90 degrees in relation to the arrow rest. When the invention is shown as held by a user, a wrist strap 39 can be attached to the wrist brace 38 to prevent the handle from rotating backwards toward the user and increase the ability to apply tension to the bands. The band can be rigid or flexible. In one embodiment, the wrist band can be adjusted to account for varying diameters in the forearms of the users. For example, for a user with a larger diameter forearm, the wrist band can be extended so that the arrow rest is maintained 90 degrees to the arrow to maximize accuracy. Without the ability to adjust the wrist band, the alignment of the arrow rest, forearm, handle ad arrow would not be optimal for accuracy or distance.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What in claimed is:

1. A modular slingshot comprising:

a handle;

a saddle included in the handle having a convex front face and a convex rear face;

a fork having fork arms and a fork extension received into the saddle;

a fork opening included in each fork arm;

a plug received into each fork opening configured to secure a band to the fork;

a thin cone portion included in the plug configured to accommodate thin bands;

a thick cone portion included in the plug configured to accommodate thick bands disposed on an opposite of the thin cone portion;

lateral groves included in the plug configured to accommodate a tubular band;

front groves included in the plug configured to accommodate a tubular band;

a bore included in the plug configured to accommodate a hollow tubular band;

a stopper configured to be received into a cavity of a hollow tubular band to expand the diameter of the hollow tubular band to secure the hollow tubular band to the fork;

a wrist brace removably attached to the handle;

an arrow rest removably attached to the fork arms by a mounting bracket; and, lateral stops include in the mounting bracket configured to prevent the band from entering an arrow stop prior to a projectile exiting the arrow rest.

2. The slingshot of claim 1 including a spring attached to the handle and configured to engage with a spring tab included in the fork to secure the fork to the handle when the fork is fully received into the handle.

3. The slingshot of claim 2 wherein the spring and the spring tab are operatively associated and configured to provide an audible indication that the fork is secured to the handle by the spring.

4. The slingshot of claim 1 including a thick indicator indicating the orientation of the thick cone portion when a thick band is used and a thin band indicator indicating the orientation of the thin cone portion when a thin band is used.

5. The slingshot of claim 1 including aiming points defined in the fork arms and disposed on lateral outer edges of the fork arms.

6. The slingshot of claim 1 including aiming points defined in upper distal ends of the mounting bracket.

7. The slingshot of claim 1 including a mounting rail attached to the handle.

8. The slingshot of claim 7 including a heel included in the handle wherein the mounting rail is attached to the heel.

9. The slingshot of claim 1 including a brace plate removable attached to the handle for securing the wrist brace to the handle.

10. The slingshot of claim 9 including a brace opening for received a bolt to removably secure the wrist brace to the handle.

11. The slingshot of claim 10 including a lanyard that can be attached to the brace opening.

12. The slingshot of claim 1 including a brace slot disposed horizontally, adjacent to a heel included in the handle and defined in the front of the handle for receiving the wrist brace.

13. The slingshot of claim 1 including an adjustable wrist strap attached to the wrist brace having a modifiable diameter to accommodate varying forearm diameters of the user and configured to allow the user to maintain a projectile orthogonal to the arrow rest.

14. A modular slingshot comprising:

a handle;

a fork removably attached to the handle having fork arms;

a fork opening included in each fork arm;

a plug received into each fork opening configured to secure a generally flat band to the fork;

a bore included in the plug configured to accommodate a hollow tubular band; and, a stopper configured to be received into a cavity of a hollow tubular band to expand the diameter of the hollow tubular band to secure the hollow tubular band to the fork.

15. The slingshot of claim 14 including a wrist brace removably attached to the handle.

16. The slingshot of claim 14 wherein the stopper is generally a sphere shape.

17. The slingshot of claim 14 including:

an arrow rest removably attached to the fork arms by a mounting bracket; and, lateral stops include in the mounting bracket configured to prevent the band from entering an arrow stop prior to a projectile exiting the arrow rest.

18. A modular slingshot comprising:

a handle;

a saddle included in the handle having a convex rear face;

a fork having fork arms and a fork extension received into the saddle;

a fork opening included in each fork arm; and, a plug received into each fork opening configured to secure a band to the fork.

19. The slingshot of claim 18 including a convex front face.

20. The slingshot of claim 19 wherein a rear curvature included in the convex rear face is greater than a front curvature included of the convex front face.

* * * * *